US011820148B2

(12) United States Patent
Horie

(10) Patent No.: US 11,820,148 B2
(45) Date of Patent: Nov. 21, 2023

(54) LIQUID STORAGE BODY AND LIQUID EJECTION APPARATUS

(71) Applicant: CANON KABUSHIKI KAISHA, Tokyo (JP)

(72) Inventor: Asuka Horie, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 120 days.

(21) Appl. No.: 17/719,204

(22) Filed: Apr. 12, 2022

(65) Prior Publication Data

US 2022/0355592 A1 Nov. 10, 2022

(30) Foreign Application Priority Data

May 6, 2021 (JP) ..... 2021-078547

(51) Int. Cl.
*B41J 2/175* (2006.01)

(52) U.S. Cl.
CPC .. *B41J 2/17523* (2013.01); *B41J 2002/17516* (2013.01)

(58) Field of Classification Search
CPC .. B41J 2/17513; B41J 2/1752; B41J 2/17523; B41J 2002/17516
See application file for complete search history.

(56) References Cited

U.S. PATENT DOCUMENTS 7,677,710 B2 * 3/2010 Kobayashi ..... B41J 2/175 347/85
10,675,875 B2 * 6/2020 Nagashima ..... B41J 2/175
2018/0104955 A1 4/2018 Kawate et al. ..... B41J 2/17523

FOREIGN PATENT DOCUMENTS

CN 204547346 U * 8/2015 ..... B41J 2/17523
JP 2018-065373 4/2018

* cited by examiner

*Primary Examiner* — Anh T Vo
(74) *Attorney, Agent, or Firm* — Venable LLP

(57) ABSTRACT

Provided is a liquid storage body, including: a liquid storage bag configured to store a liquid containing precipitation components; a liquid introduction pipe arranged in the liquid storage bag; and a liquid discharge unit fixed at one end portion of the liquid storage bag and configured to discharge the liquid introduced from the liquid introduction pipe to a liquid ejection apparatus, in which the liquid introduction pipe includes a spacer portion including at least two liquid introduction ports at different positions in a height direction at a predetermined orientation, a convergence portion at which the liquids introduced from the at least two liquid introduction ports are converged with each other; and a flow channel configured to introduce the converged liquids to the liquid discharge unit.

12 Claims, 11 Drawing Sheets

LIQUID STORAGE BODY AND LIQUID EJECTION APPARATUS

BACKGROUND OF THE INVENTION

Field of the Invention

The present invention relates to a technique of a liquid storage body that supplies a liquid to a liquid ejection apparatus.

Description of the Related Art

Conventionally, a liquid storage body that supplies a liquid to a liquid ejection apparatus has been widely used. Japanese Patent Laid-Open No. 2018-65373 discloses a liquid storage body that supplies a liquid containing precipitation components while keeping a stable density. Specifically, Japanese Patent Laid-Open No. 2018-65373 discloses a liquid storage body that includes two pipes for discharging a liquid in a liquid storage bag to a liquid discharge member and that can introduce the liquid from two portions at different heights in the liquid storage bag.

However, the liquid storage body of Japanese Patent Laid-Open No. 2018-65373 has a risk that the liquid that is not completely introduced to the pipes remains in the shrunk liquid storage bag, and thus the liquid cannot be sufficiently supplied to the liquid ejection apparatus.

In view of this, an object of the present invention is to improve the efficiency of use of a liquid in a liquid storage bag.

SUMMARY OF THE INVENTION

A liquid storage body according to one aspect of the present invention includes: a liquid storage bag configured to store a liquid containing precipitation components; a liquid introduction pipe arranged in the liquid storage bag; and a liquid discharge unit fixed at one end portion of the liquid storage bag and configured to discharge the liquid introduced from the liquid introduction pipe to a liquid ejection apparatus, in which the liquid introduction pipe includes a spacer portion including at least two liquid introduction ports at different positions in a height direction at a predetermined orientation, a convergence portion at which the liquids introduced from the at least two liquid introduction ports are converged with each other; and a flow channel configured to introduce the converged liquids to the liquid discharge unit.

Further features of the present invention will become apparent from the following description of exemplary embodiments with reference to the attached drawings.

DESCRIPTION OF THE EMBODIMENTS

A liquid storage body is mounted in a liquid ejection apparatus, for example. The liquid storage body includes a liquid storage bag containing an ink and discharges the ink to a liquid ejection apparatus in accordance with an operation of the liquid ejection apparatus. In the liquid storage bag, an internal structure is arranged, and the ink in the liquid storage bag is ejected to the outside by the operation of the internal structure. However, in the liquid storage body with an internal structure including two pipes for discharging a liquid and a coupling member, in a case where the liquid storage bag is shrunk with the consumption of the ink, the close-touch performance between the liquid storage bag, the pipes, and the coupling member is bad, and a void occurs. There is a risk that the liquid remains in the void and thus the ink in the liquid storage bag cannot be sufficiently discharged. In the following embodiments, a method of improving the efficiency of use of the ink in the liquid storage bag by improving the close-touch performance of the internal structure with the liquid storage bag is described with reference to the drawings. As the "liquid" in the descriptions below, an ink containing precipitation components is used as an example for the descriptions; however, as long as it is a liquid containing precipitation components, it is not limited to an ink.

Embodiment 1

Figure 1:
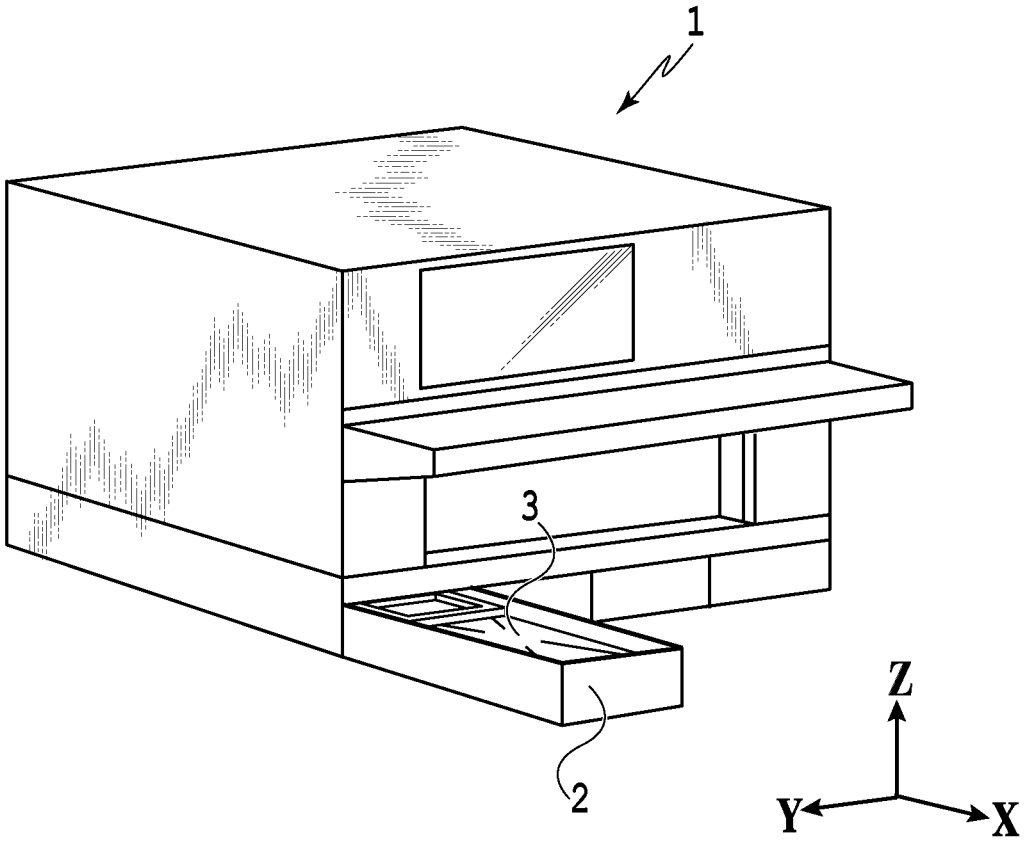
FIG. 1 is a perspective view of a liquid ejection apparatus in which a liquid storage body is mounted.

FIG. 1 is a perspective view of a liquid ejection apparatus 1 in which a liquid storage body 3 is mounted. Here, a direction in which the liquid storage body 3 advances and retracts with respect to the liquid ejection apparatus 1 during attachment and detachment of the liquid storage body 3 to and from the liquid ejection apparatus 1 is an X direction. A width direction of the liquid storage body 3 is a Y direction, and a thickness direction of the liquid storage body 3 is a Z direction. The X direction, the Y direction, and the Z direction are orthogonal to each other. A state where the liquid storage body 3 is mounted in the liquid ejection apparatus 1 at a predetermined orientation is called a mounting state. The liquid storage body 3 is mounted in the liquid ejection apparatus 1 in a direction in which the thickness direction coincides with a vertical direction; accordingly, the Z direction coincides with the vertical direction in the mounting state.

The liquid ejection apparatus 1 includes a liquid ejection unit including a liquid ejection head, a storage unit of a record medium, a conveyance mechanism of the record medium, and the like (that are not illustrated). The liquid storage body 3 stored in a cassette 2 is mounted in the liquid ejection apparatus 1. The liquid storage body 3 stores an ink to be ejected from the liquid ejection head of the liquid ejection apparatus 1. In the present embodiment, four liquid storage bodies 3 storing inks of cyan (C), magenta (M), yellow (Y), and black (K), respectively, are mounted in the liquid ejection apparatus 1. The sizes of the four liquid storage bodies 3 are the same; however, for example, the liquid storage body 3 of the black ink may be greater than the liquid storage bodies 3 of the inks of the other colors. The cassette 2 in which each liquid storage body 3 is stored is attachable and detachable to and from the liquid ejection apparatus 1 and advances and retracts in the X direction.

Figure 2:
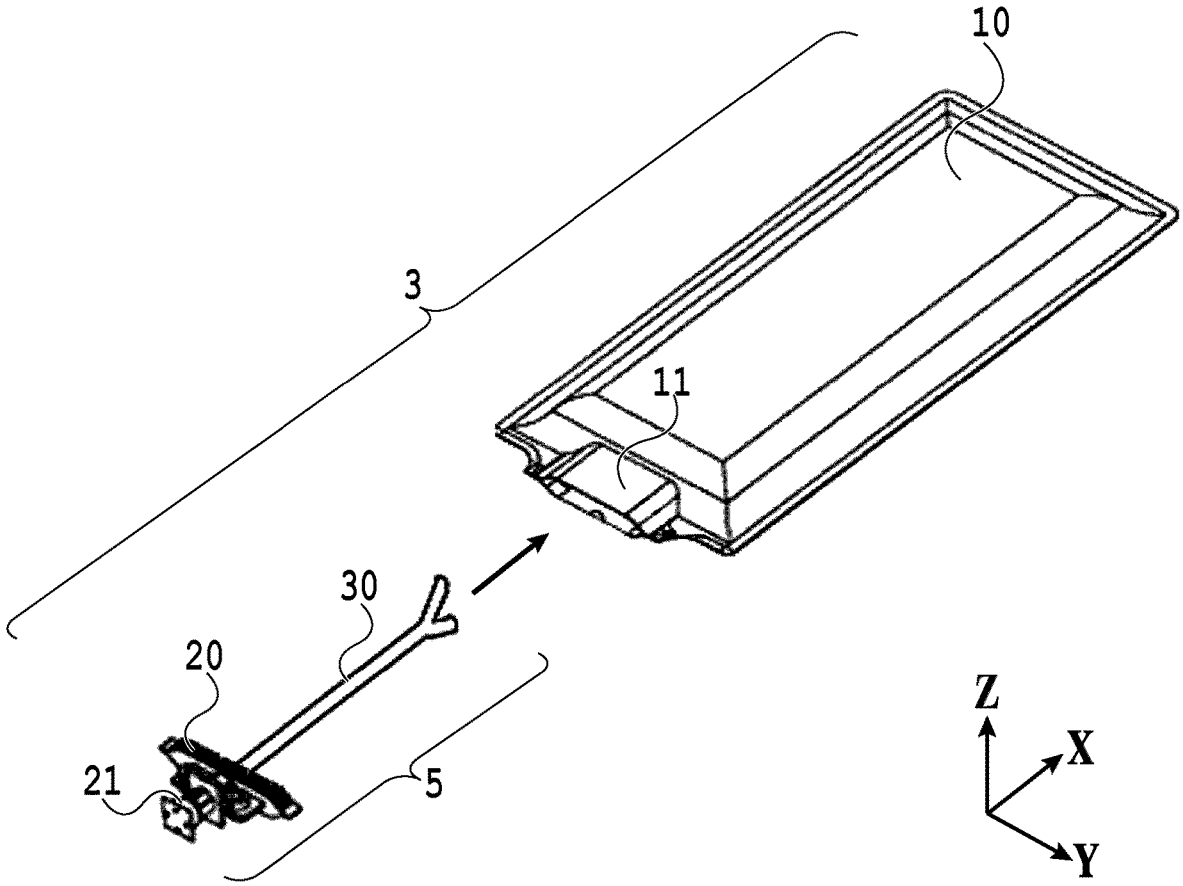
FIG. 2 is a perspective view of a state where an internal structure is taken out from a liquid storage bag.

FIG. 2 is a perspective view illustrating a liquid storage bag 10 and an internal structure 5 of the liquid storage body 3. The internal structure 5 includes a liquid discharge member 20 and a liquid introduction pipe 30 and is arranged in the liquid storage bag 10 through a connection port 11 that is provided in advance at one end portion of the liquid storage bag 10. A part of the liquid discharge member 20 and a part of the connection port 11 of the liquid storage bag 10 are then sealed by welding, and the liquid is poured in the liquid storage bag 10. As the liquid storage bag 10, a bag that has a flat shape in a shrinkage state is used.

Figure 3:
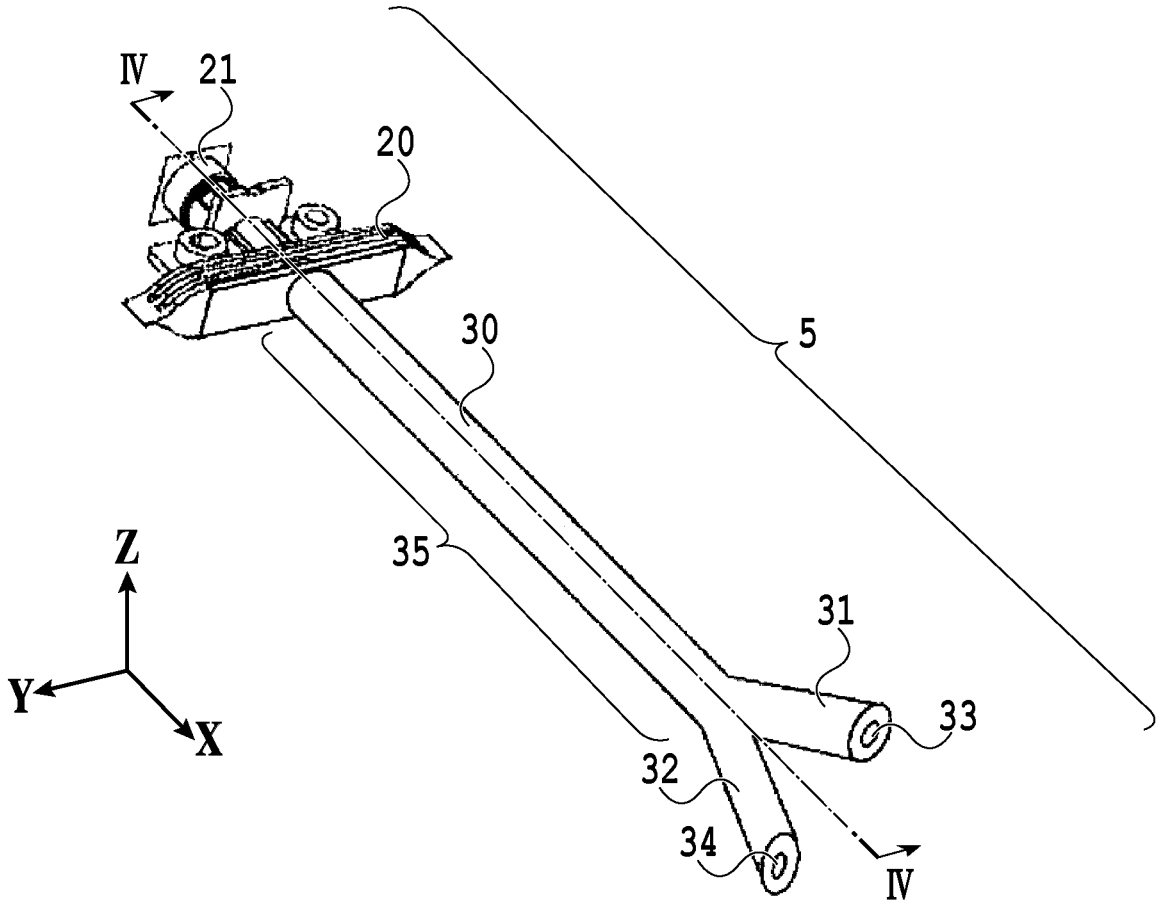
FIG. 3 is a perspective view of the internal structure of the liquid storage body.

FIG. 3 is a perspective view illustrating a state where the internal structure 5 is taken out from the liquid storage bag 10. The liquid introduction pipe 30 is formed of synthetic resin such as polyethylene or polypropylene, for example. The liquid introduction pipe 30 is a hollow structure including a single flow channel therein, and one end portion thereof is coupled to the liquid discharge member 20.

As illustrated in FIG. 3, a tip of the liquid introduction pipe 30 is obliquely branched in an upward direction and a downward direction in the Z direction, and a first introduction pipe portion 31 on the upper side and a second introduction pipe portion 32 on the lower side are provided.

In the first introduction pipe portion 31, a first introduction port 33 is provided, and in the second introduction pipe portion 32, a second introduction port 34 is provided. In a case where the internal structure 5 is arranged in the liquid storage bag 10, the first introduction pipe portion 31 and the second introduction pipe portion 32 are positioned in a center portion that is near the center of the liquid storage bag 10 in the X direction.

Figure 4:
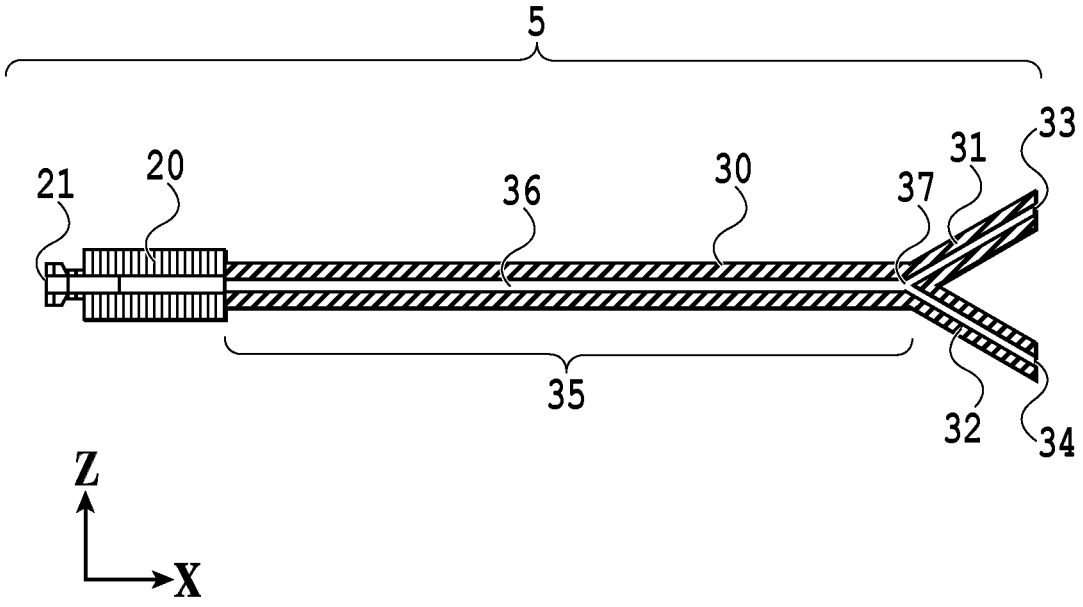
FIG. 4 is a cross-sectional view of the internal structure of the liquid storage body.

FIG. 4 is a cross-sectional view taken along Iv-Iv of the internal structure 5 in FIG. 3. The liquids introduced from the first introduction port 33 and the second introduction port 34 are converged at a convergence portion 37, flow through a flow channel 36 in an introduction pipe portion 35 and the liquid discharge member 20 after the convergence, and are discharged to a liquid discharge unit 21. Since the liquid contains precipitation components, the density in the liquid storage bag 10 is low in an upper portion and high in a lower portion. For this reason, the first introduction port 33 provided on the upper side introduces the liquid of a low density, and the second introduction port 34 introduces the liquid of a high density. The introduced liquids of different densities are converged at the convergence portion 37 inside the liquid introduction pipe 30, pass through the flow channel 36 and the liquid discharge member 20, and are supplied to the liquid ejection apparatus 1. With this, it is possible to allow the liquids to pass through the flow channel 36 after the convergence near the introduction ports without converging the liquids in or after the liquid discharge member 20. That is, with the extension of a path through which the liquids of different densities are mixed with each other, the densities of the liquids are more uniformed until reaching the liquid discharge unit, and consequently the image quality of the liquid ejection head is improved. The length of the flow channel 36 in the Z direction is a length that can ignore the precipitation of the liquid inside the flow channel more than the liquid storage bag 10 does. The first introduction pipe portion 31 and the second introduction pipe portion 32 obliquely branched in the two upward and downward directions section a region of a certain inner volume in the liquid storage bag 10. With this, the first introduction pipe portion 31 and the second introduction pipe portion 32 also have a role as a spacer that prevents a flowing path of the liquid in the liquid storage bag 10 from being closed. That is, in a case where the liquid storage bag 10 is shrunk with the liquid consumption, it is possible to prevent shrinkage from a center portion.

Additionally, the structure in which there is the flow channel 36 inside the liquid introduction pipe 30 simplifies the structure of the internal structure more than a configuration using a coupling member for coupling a spacer portion and multiple liquid introduction pipes for introducing the liquid. That is, a further compact configuration is obtained with the single liquid introduction pipe 30 having a role as a spacer and also a role to introduce the liquid to the liquid discharge unit 21. With this, in a case where the liquid storage bag 10 is shrunk with the liquid consumption, a contact surface between the inner side of the liquid storage bag 10 and the internal structure 5 can be reduced. With the contact surface being reduced, a void between the liquid storage bag 10 and the internal structure 5 is reduced, and the volume of the liquid that is not used until last can be reduced; thus, the efficiency of use of the liquid is improved.

As described above, according to the present embodiment, it is possible to improve the efficiency of use of the liquid in the liquid storage bag. Specifically, with the liquid introduction pipe having the function as a spacer, it is possible to prevent a situation where the introduction port is closed due to the shrinkage of the liquid storage bag and the liquid is not introduced easily. Additionally, with the liquids of different densities being allowed to pass through the flow channel after being converged at the convergence portion, it is possible to discharge the liquid of further uniformed density to the liquid ejection apparatus.

Embodiment 2

In Embodiment 1, the liquid introduction pipe 30 has the function of a spacer and the function of the liquid introduction; however, in Embodiment 2, an internal structure in which a liquid introduction pipe and a spacer member are separated from each other is described. A description of a member that has the same role as that in Embodiment 1 is omitted.

Figure 5:
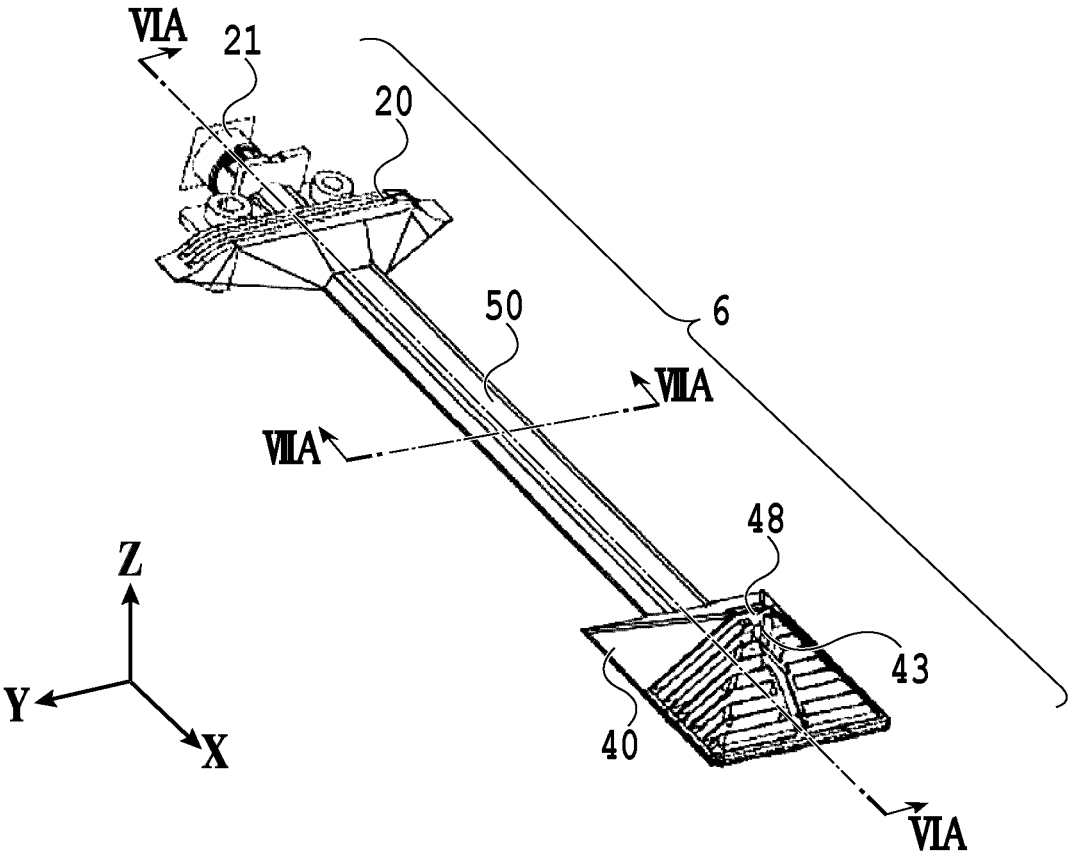
FIG. 5 is a perspective view of the internal structure of the liquid storage body.

FIG. 5 is a perspective view illustrating a state where an internal structure 6 is taken out from the liquid storage bag 10. A coupling liquid introduction pipe 50 is formed of synthetic resin such as polyethylene or polypropylene, for example. The coupling liquid introduction pipe 50 includes a flow channel therein, while one end portion thereof is coupled to the liquid discharge member 20, and the other end portion is coupled to a spacer member 40.

As with the first introduction pipe portion 31 and the second introduction pipe portion 32 in FIG. 3, the spacer member 40 is a structure that sections a region of a certain inner volume in the liquid storage bag 10. The spacer member 40 is formed of synthetic resin such as polyethylene or polypropylene, for example.

Figure 6A:
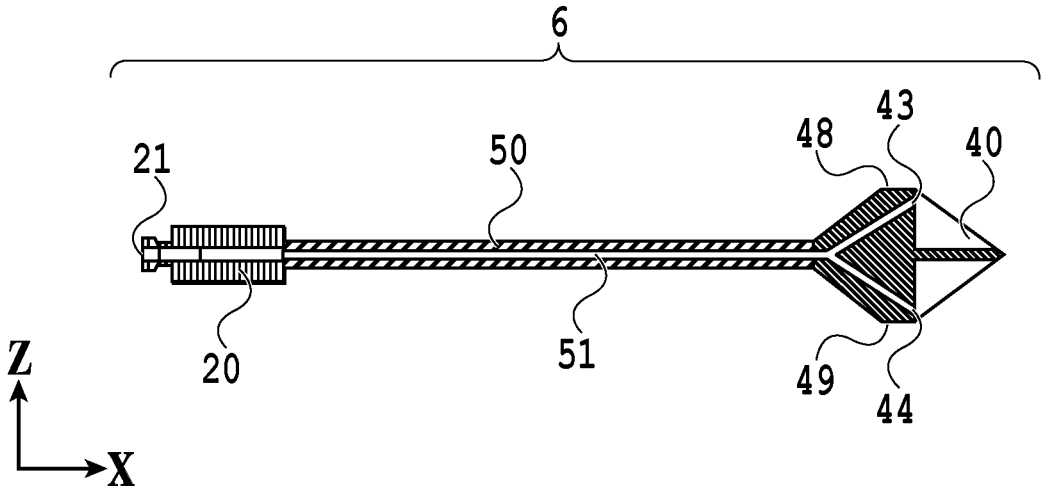
FIGS. 6A and 6B are cross-sectional views of the internal structure of the liquid storage body.
Figure 6B:
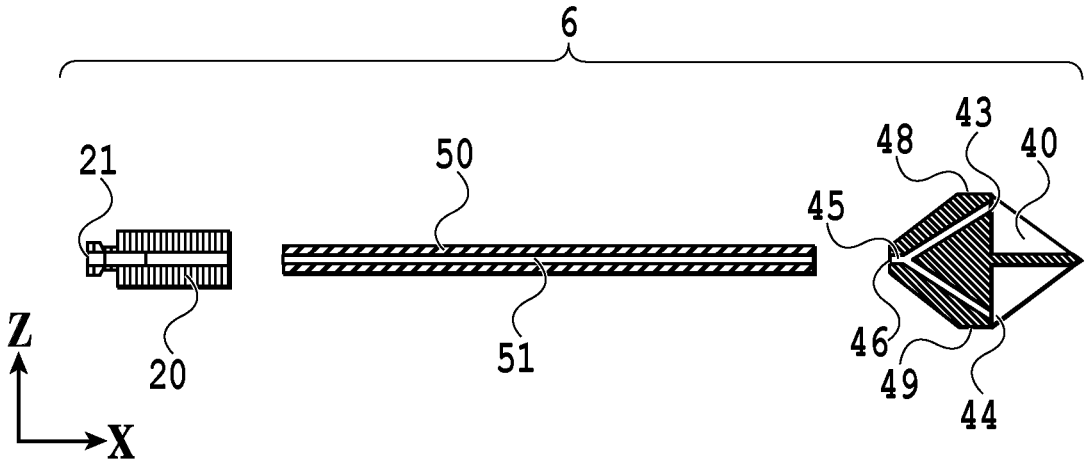

FIGS. 6A and 6B are cross-sectional views taken along VIA-VIA of the internal structure 6 in FIG. 5. FIG. 6A is a cross-sectional view of a state where the liquid discharge member 20, the coupling liquid introduction pipe 50, and the spacer member 40 are coupled with each other. FIG. 6B is a cross-sectional view of a state before the liquid discharge member 20, the coupling liquid introduction pipe 50, and the spacer member 40 are coupled with each other. A flow channel is provided inside the coupling liquid introduction pipe 50. With the coupling liquid introduction pipe 50 having the function of fixing the spacer member 40 at a fixed position and the function of allowing the communication from the spacer member 40 to the liquid discharge unit 21, the whole structure is simplified. With this, in a case where the liquid is consumed and the liquid storage bag 10 is shrunk, a void between the liquid storage bag 10 and the internal structure 6 is reduced, and the volume of the liquid that is not used can be reduced; thus, the efficiency of use of the liquid is improved.

In the spacer member 40, a first introduction port 43 and a second introduction port 44 are provided in upward and downward directions. The liquids introduced from the first introduction port 43 and the second introduction port 44 are converged at a convergence portion 45 inside the spacer member 40 and communicate with a convergence flow channel port 46. The convergence flow channel port 46 is connected so as to communicate with one end portion of a flow channel 51 included in the coupling liquid introduction pipe 50.

Because of the precipitation components, the density of the liquid in the liquid storage bag 10 is low in an upper portion and high in a lower portion. For this reason, the first introduction port 43 provided in the upper portion introduces the liquid of a low density, and the second introduction port 44 provided in the lower portion introduces the liquid of a high density. The introduced liquids of different densities are converged at the convergence portion 45 provided inside the spacer member 40, pass through the flow channel 51 inside the coupling liquid introduction pipe 50 and the inside of the liquid discharge member 20, and are supplied to the liquid ejection apparatus 1. With this, as with the internal structure 5 in FIG. 4, a path for mixing the liquids of different densities is extended, the density of the liquid is further uniformed, and consequently the image quality of the liquid ejection head is improved.

In the present embodiment, the spacer member 40 has a shape of a substantially square pyramid in both the upward and downward directions, and a bottom surface of the square pyramid is parallel to an X-Y plane. In the present embodiment, the substantially square pyramid includes a shape in which vertices 48 and 49 of the square pyramid in the Z direction are R-processed or a shape of a frustum of square pyramid in which an X-Y plane is formed. Otherwise, the shape is not limited to a substantially square pyramid, and a shape of a polygonal pyramid such as a substantially triangle pyramid or a substantially pentagonal pyramid may be applied.

With the spacer member 40 having a shape of a substantially square pyramid, the inside of the liquid storage bag 10 that is shrunk because of the liquid consumption is put in close contact with the internal structure 6 more easily than the shapes of the first introduction pipe portion 31 and the second introduction pipe portion 32 having a role of a spacer in Embodiment 1. Since the spacer member 40 has a shape of a substantially square pyramid, the vertex 48 or 49 of the square pyramid is put in contact with the liquid storage bag 10 first, and from the portion in contact, the liquid storage bag 10 is started to be put in contact with the internal structure 6. With an inclined surface being provided in all the directions of the spacer member 40, shrinkage is easily made along the incline of the spacer member 40 during the shrinkage of the liquid storage bag 10, and thus it is possible to more effectively suppress the closing of the flowing path of the liquid inside the liquid storage body 3. Additionally, with the close-touch performance of the shrunk liquid storage bag 10 and the spacer member 40 being improved, a void between the liquid storage bag 10 and the internal structure 6 is reduced, and the liquid remaining in the liquid storage bag 10 that is not used can be reduced; thus, the efficiency of use of the liquid is improved. In a part of the spacer member, a groove is formed and has a role of a guide unit introducing the liquid to the first introduction port 43 and the second introduction port 44 even if the spacer member 40 is covered with the liquid storage bag 10.

Figure 7A:
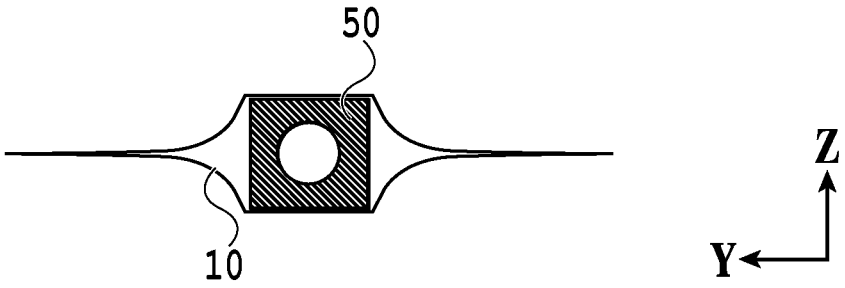
FIGS. 7A to 7D are cross-sectional views of a coupling liquid introduction pipe.
Figure 7B:
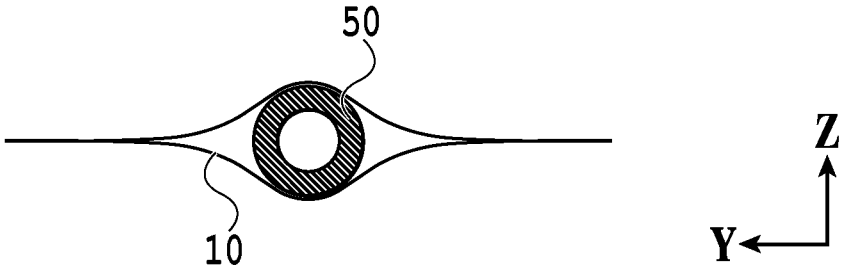
Figure 7C:
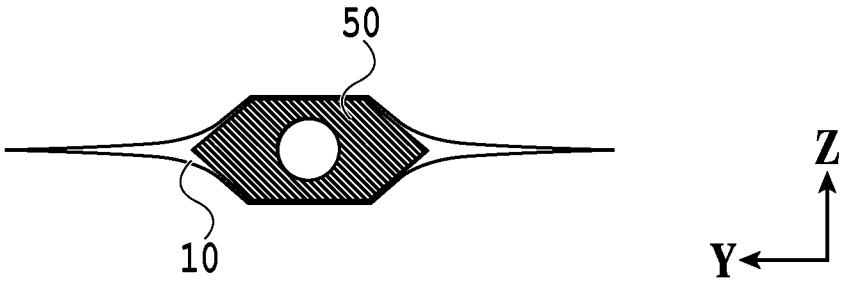
Figure 7D:
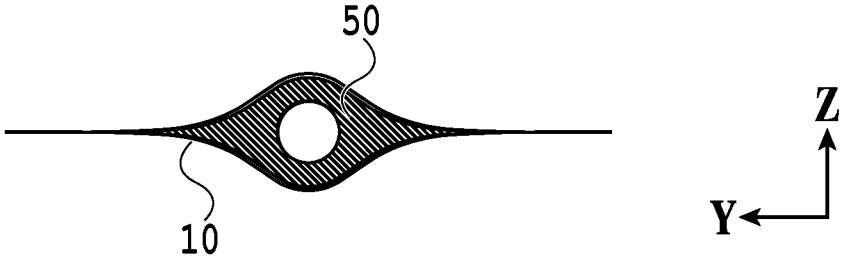

FIGS. 7A to 7D are cross-sectional views taken along VIIA-VIIA of the coupling liquid introduction pipe 50 in FIG. 5. The close-touch performance of the liquid storage bag 10 and the coupling liquid introduction pipe 50 is changed depending on the shape of the coupling liquid introduction pipe 50. For example, in a case of a square shape as illustrated in FIG. 7A, the bag is shrunk into a flat shape; for this reason, the close-touch performance of the liquid storage bag 10 to the coupling liquid introduction pipe 50 is bad, and a void occurs easily between the liquid storage bag 10 and the internal structure 6. In contrast, as illustrated in FIGS. 7B, 7C, and 7D, with R-processing being performed or an incline or a curve being provided at a corner portion of the square in FIG. 7A, the close-touch performance of the liquid storage bag 10 to the coupling liquid introduction pipe 50 is enhanced. The close-touch performance is enhanced more as the coupling liquid introduction pipe 50 has a shape closer to the shape of the shrunk liquid storage bag 10. The cross section shape of the coupling liquid introduction pipe 50 is not limited to the illustrated shape. As described above, with the close-touch performance of the liquid storage bag 10 and the spacer member 40 being improved during the shrinkage of the liquid storage bag 10, the liquid remaining in the liquid storage bag 10 that is not used can be reduced, and thus the efficiency of use of the liquid is improved. Additionally, the shape of the coupling liquid introduction pipe 50 illustrated in FIG. 7 may be applied to the shape of the liquid introduction pipe 30 in Embodiment 1.

In the present embodiment, the coupling liquid introduction pipe 50 is coupled with the liquid discharge member 20 and the spacer member 40. In a case of being coupled, the coupling of the members and the connection of the flow channels inside the members are performed together.

Figure 8A:
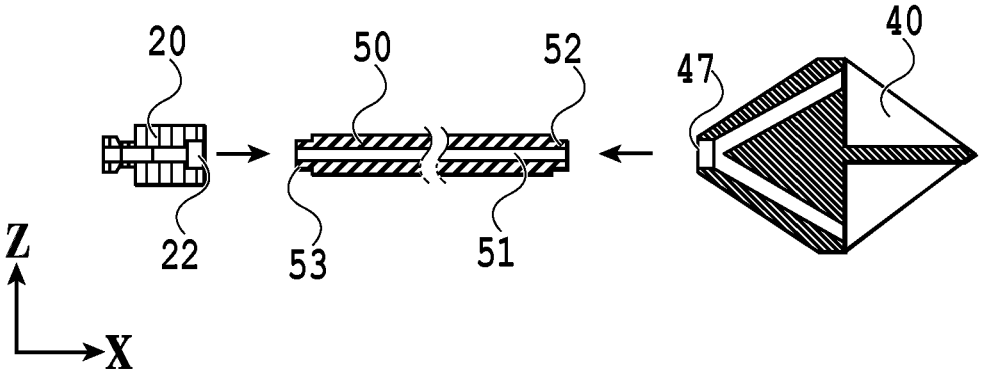
FIGS. 8A and 8B are cross-sectional views of a coupling step of the internal structure of the liquid storage body.
Figure 8B:
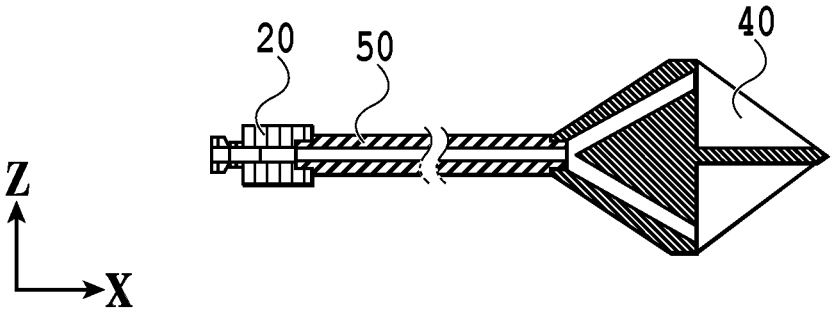

FIGS. 8A and 8B are diagrams illustrating a coupling method of the members in a VIA-VIA cross section in FIG. 5. In the present embodiment, tips 52 and 53 in a rib shape are provided at two ends of the coupling liquid introduction pipe 50 illustrated in FIG. 8A. On a liquid discharge member 20 side, a coupling portion 22 smaller than an outer diameter of the tip 53 is prepared, and the tip 53 is press-fitted and coupled thereto. Likewise, a coupling portion 47 smaller than an outer diameter of the tip 52 is also prepared for the spacer member 40, and the tip 52 is press-fitted and coupled thereto. FIG. 8B is a state where the coupling liquid introduction pipe 50 is already coupled with the liquid discharge member 20 and the spacer member 40.

Figure 9:
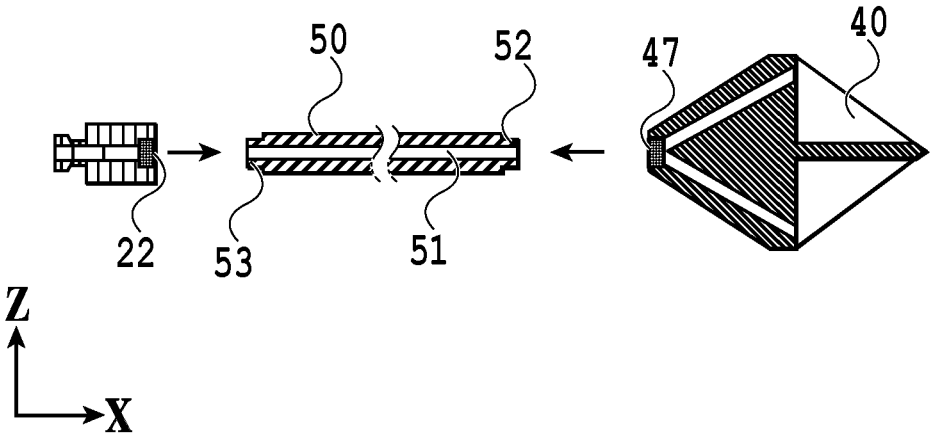
FIG. 9 is a cross-sectional view of a coupling step of the internal structure of the liquid storage body.

FIG. 9 is a diagram illustrating a method of press-fitting in a case of using a thread-fastening method in a VIA-VIA cross section in FIG. 5. The tips 52 and 53 of the coupling liquid introduction pipe 50 have a tapped male screw shape, and the coupling portion 22 of the liquid discharge member 20 and the coupling portion 47 of the spacer member 40 have a female screw shape. With those shapes, the coupling of the members by the thread-fastening method and the flow channel communication inside the members can be performed.

Figure 10A:
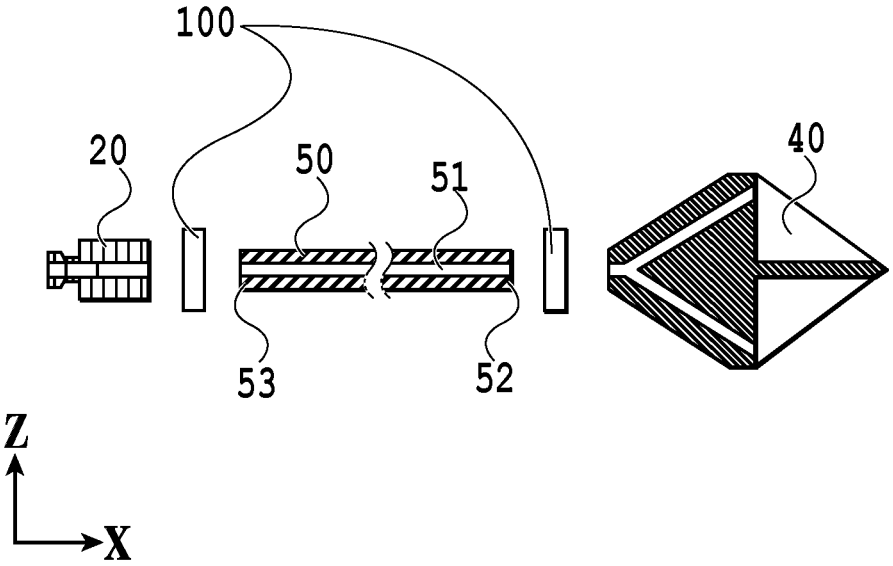
FIGS. 10A and 10B are cross-sectional views of a coupling step of the internal structure of the liquid storage body.
Figure 10B:
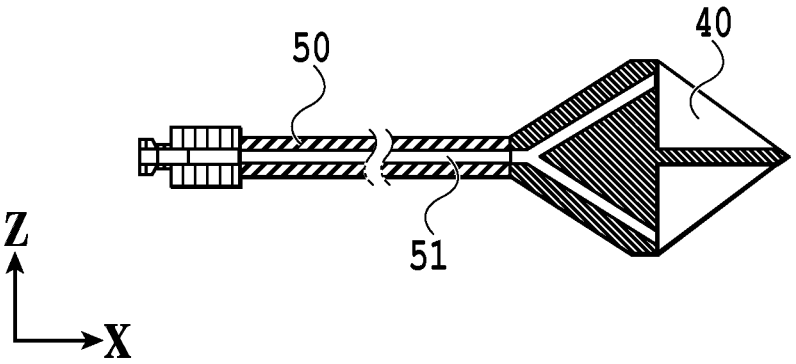

Additionally, as illustrated in FIG. 10A, by using a heater 100, the liquid discharge member 20, the spacer member 40, and the coupling liquid introduction pipe 50 may be coupled by thermal welding in which heating at a melting point or higher the members and attaching them with each other. FIG. 10B is a diagram illustrating a state where the liquid discharge member 20, the spacer member 40, and the coupling liquid introduction pipe 50 are already coupled with each other by thermal welding. The method of coupling the liquid discharge member 20, the spacer member 40, and the coupling liquid introduction pipe 50 is not limited to the above. For example, it is also possible to perform the coupling by a welding method using ultrasonic welding or vibration welding to a welding position similar to that in FIG. 10A (not illustrated). Otherwise, an integral object in which the liquid discharge member 20, the coupling liquid introduction pipe 50, and the spacer member 40 are coupled may be created by die molding (not illustrated).

As described above, according to the present embodiment, with the liquid discharge member, the coupling liquid introduction pipe, and the spacer member being separated from each other, each member can be created so as to improve the close-touch performance between each member and the liquid storage bag. With those members being coupled, the liquid remaining in the liquid storage bag that is not used can be further reduced; thus, the efficiency of use of the liquid is improved.

Embodiment 3

In Embodiment 3, a configuration in which a spacer member provided with a guide unit is coupled to the coupling liquid introduction pipe provided with the first introduction port and the second introduction port is described. Since the coupling of the liquid discharge member and the coupling liquid introduction pipe is similar to that in Embodiment 2, the description is omitted.

Figure 11:
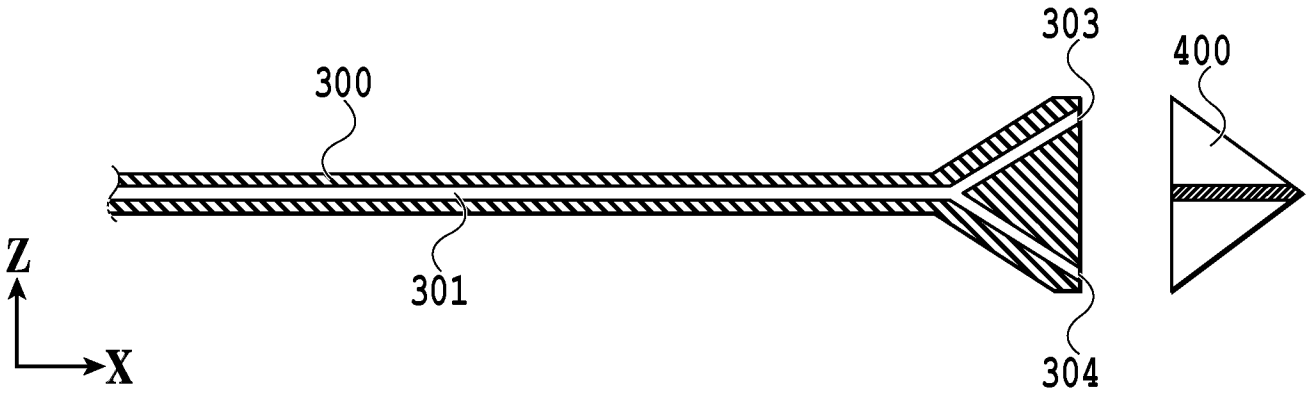
FIG. 11 is a cross-sectional view of a coupling step of the internal structure of the liquid storage body.

FIG. 11 is a state before the coupling of a coupling liquid introduction pipe 300 and a spacer member 400. As illustrated in FIG. 11, in the present embodiment, the coupling liquid introduction pipe 300 provided with a first introduction port 303 and a second introduction port 304 and the spacer member 400 are coupled with each other. The coupling liquid introduction pipe 300 converges the liquids introduced from the first introduction port 303 and the second introduction port 304, respectively, inside the coupling liquid introduction pipe 300. The spacer member 400 has a function as a spacer without being provided with the liquid introduction port or the flow channel. The spacer member 400 has a shape similar to a portion of the spacer member 40 and has a role similar to the portion of the spacer member 40.

Since the shape in a case of coupling the coupling liquid introduction pipe 300 and the spacer member 400 is a shape similar to the internal structure 6 in Embodiment 2 illustrated in FIG. 5, a similar effect can be obtained. A coupling method of the coupling liquid introduction pipe 300 and the spacer member 400 may be coupling by press-fitting as described in Embodiment 2 (FIG. 8), coupling by a thread-fastening method (FIG. 9), coupling by thermal welding (FIG. 10), coupling by fitting (not illustrated), and the like; however, it is not limited to those methods.

As described above, according to the present embodiment, in the coupling of the coupling liquid introduction pipe 300 and the spacer member 400, since the flow channel is formed in the coupling liquid introduction pipe 300, only the coupling of the members is required, and the connection of inner flow channels is not required. Therefore, comparing with Embodiment 2, the sealing properties of the flow channels to be connected does not have to be taken into consideration, and it is possible to select various fixing methods.

Other Embodiments

In Embodiment 1, a case where the two first introduction pipe portion and second introduction pipe portion that introduce the liquid in the liquid storage bag to the liquid discharge member are provided in the upper and lower portions is described; however, it is not limited thereto.

For example, three introduction pipe portions as a total may be provided in upward, middle, and downward directions. Although an example where one liquid introduction port is provided in each of the first introduction pipe portion and the second introduction pipe portion is described, it is not limited thereto as well. A mode in which multiple liquid introduction ports are provided in one introduction pipe portion in order to change the suction efficiency or the suction ratio may be applied.

According to the present invention, it is possible to improve the efficiency of use of a liquid in a liquid storage bag.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-078547 filed May 6, 2021, which is hereby incorporated by reference wherein in its entirety.

What is claimed is:

1. A liquid storage body, comprising:

a liquid storage bag configured to store a liquid containing precipitation components;

a liquid introduction pipe arranged in the liquid storage bag; and a liquid discharge unit fixed at one end portion of the liquid storage bag and configured to discharge the liquid introduced from the liquid introduction pipe to a liquid ejection apparatus, wherein the liquid introduction pipe includes a spacer portion including at least two liquid introduction ports at different positions in a height direction at a predetermined orientation, a convergence portion at which the liquids introduced from the at least two liquid introduction ports are converged with each other; and a flow channel configured to introduce the converged liquids to the liquid discharge unit.

2. The liquid storage body according to claim 1, wherein the liquid introduction ports are arranged at two positions, which are a position higher than and a position lower than the convergence portion of the liquid introduction pipe in the height direction.

3. The liquid storage body according to claim 1, wherein in the liquid introduction pipe, the spacer portion and the flow channel are formed of an integral member.

4. The liquid storage body according to claim 1, wherein the spacer portion includes a guide unit configured to guide the liquid stored in the liquid storage bag to the liquid introduction port.

5. The liquid storage body according to claim 4, wherein the liquid introduction pipe is formed by coupling a member forming the spacer portion and a member forming the flow channel with each other.

6. The liquid storage body according to claim 4, wherein the liquid introduction pipe is formed by coupling a member forming the liquid introduction port of the spacer portion and a member forming the guide unit with each other.

7. The liquid storage body according to claim 1, wherein the convergence portion is included in a member forming the spacer portion.

8. The liquid storage body according to claim 1, wherein the flow channel has a length from one end portion of the liquid storage bag to a center portion of the liquid storage bag.

9. The liquid storage body according to claim 1, wherein a cross section shape of the flow channel is a shape according to a shape of the liquid storage body in a shrunk state.

10. The liquid storage body according to claim 1, further comprising:

a coupling member configured to couple the liquid introduction pipe and the liquid discharge unit with each other, wherein the liquid storage body is formed by coupling the coupling member coupled to the liquid discharge unit and the flow channel with each other.

11. The liquid storage body according to claim 1, wherein the predetermined orientation is an orientation in a state where the liquid storage body is mounted in the liquid ejection apparatus.

12. A liquid ejection apparatus, comprising:

a liquid storage body, including:

a liquid storage bag configured to store a liquid containing precipitation components;

a liquid introduction pipe arranged in the liquid storage bag; and a liquid discharge unit fixed at one end portion of the liquid storage bag and configured to discharge the liquid introduced from the liquid introduction pipe to a liquid ejection apparatus, wherein the liquid introduction pipe includes a spacer portion including at least two liquid introduction ports at different positions in a height direction at a predetermined orientation, a convergence portion at which the liquids introduced from the at least two liquid introduction ports are converged with each other; and a flow channel configured to introduce the converged liquids to the liquid discharge unit; and a liquid ejection unit configured to eject the liquid supplied from the liquid storage body.

* * * * *